US006651357B2

(12) United States Patent
Bria et al.

(10) Patent No.: US 6,651,357 B2
(45) Date of Patent: Nov. 25, 2003

(54) WEB DRYER WITH FULLY INTEGRATED REGENERATIVE HEAT SOURCE AND CONTROL THEREOF

(75) Inventors: Michael P. Bria, Green Bay, WI (US); Alan D. Fiers, De Pere, WI (US); Andreas C. H. Rühl, De Pere, WI (US)

(73) Assignee: Megtec Systems, Inc., De Pere, WI (US)

( * ) Notice: Subject to any disclaimer, the term of this patent is extended or adjusted under 35 U.S.C. 154(b) by 0 days.

(21) Appl. No.: 09/759,681

(22) Filed: Jan. 12, 2001

(65) Prior Publication Data

US 2002/0092198 A1 Jul. 18, 2002

(51) Int. Cl.[7] ..... F26B 7/00; F26B 3/00; F26B 21/06

(52) U.S. Cl. ..... 34/427; 34/514; 34/515; 34/566; 34/571; 34/77; 34/74; 34/86

(58) Field of Search ..... 34/427, 444, 467, 34/513, 514, 515, 548, 550, 551, 562, 566, 567, 571, 576, 72, 74, 77, 86

(56) References Cited

U.S. PATENT DOCUMENTS

| | | | | | |
|---|---|---|---|---|---|
| 2,936,162 | A | | 5/1960 | Coberly | 263/51 |
| 3,870,474 | A | | 3/1975 | Houston | 23/277 C |
| 3,895,918 | A | | 7/1975 | Mueller | 23/277 C |
| 3,936,951 | A | * | 2/1976 | Haueise | |
| 4,137,648 | A | * | 2/1979 | Rhodes | 34/86 |
| 4,270,283 | A | * | 6/1981 | Ellis | 34/212 |
| 4,337,585 | A | | 7/1982 | Hebrank | 34/86 |
| 4,343,769 | A | * | 8/1982 | Henkelmann | 422/109 |
| 4,398,700 | A | * | 8/1983 | Thome | 266/111 |
| 4,501,318 | A | | 2/1985 | Hebrank | 165/1 |
| 4,966,228 | A | | 10/1990 | Fawcett | 165/4 |
| 4,989,348 | A | | 2/1991 | Vits | 34/155 |
| 5,207,008 | A | | 5/1993 | Wimberger et al. | 34/23 |
| 5,210,961 | A | | 5/1993 | Jacobs et al. | 34/155 |
| 5,303,484 | A | * | 4/1994 | Hagen et al. | 34/155 |
| 5,528,839 | A | * | 6/1996 | Seidl | 34/364 |
| 5,555,635 | A | * | 9/1996 | Seidl | 34/79 |
| 5,601,789 | A | * | 2/1997 | Ruhl et al. | 422/168 |
| 5,640,784 | A | * | 6/1997 | Rocheleau | 34/541 |
| 5,937,535 | A | * | 8/1999 | Hoffman et al. | 34/78 |
| 6,006,446 | A | | 12/1999 | Pagendarm | 34/633 |
| 6,058,626 | A | * | 5/2000 | De Vroome et al. | 34/539 |
| 6,213,758 | B1 | * | 4/2001 | Tesar et al. | 431/12 |
| 6,264,464 | B1 | * | 7/2001 | Bria | 431/215 |
| 6,321,462 | B1 | * | 11/2001 | Seidl et al. | 34/423 |

FOREIGN PATENT DOCUMENTS

| | | |
|---|---|---|
| EP | 0 326 228 | 8/1989 |

* cited by examiner

*Primary Examiner*—Kenneth B. Rinehart
(74) *Attorney, Agent, or Firm*—Mitchell D. Bittman; Kevin S. Lemack

(57) ABSTRACT

Integrated web dryer and regenerative heat exchanger, as well as a method of drying a web of material using the same. The apparatus and method of the present invention provides for the heating of air and the converting of VOCs to harmless gases in a fully integrated manner via the inclusion of a regenerative combustion device as an integral element of the drying apparatus.

22 Claims, 18 Drawing Sheets

WEB DRYER WITH FULLY INTEGRATED REGENERATIVE HEAT SOURCE AND CONTROL THEREOF

BACKGROUND OF THE INVENTION

The control and/or elimination of undesirable impurities and by-products from various manufacturing operations has gained considerable importance in view of the potential pollution such impurities and by-products may generate. One conventional approach for eliminating or at least reducing these pollutants is by thermal oxidation. Thermal oxidation occurs when contaminated air containing sufficient oxygen is heated to a temperature high enough and for a sufficient length of time to convert the undesired compounds into harmless gases such as carbon dioxide and water vapor.

Control of web drying apparatus, including flotation dryers capable of contactless supporting and drying a moving web of material, such as paper, film or other sheet material, via heated air issuing from a series of typically opposing air nozzles, requires a heat source for the heated air. Additionally, as a result of the drying process, undesirable volatile organic compounds (VOCs) may evolve from the moving web of material, especially where the drying is of a coating of ink or the like on the web. Such VOCs are mandated by law to be converted to harmless gases prior to release to the environment.

Prior art flotation drying apparatus have been combined with various incinerator or afterburner devices in a separated manner in which hot, oxidized gases are retrieved from the exhaust of the thermal oxidizer and returned to the drying device. These systems are not considered fully integrated due to the separation of oxidizer and dryer components and the requirement of an additional heating appliance in the drying enclosure. Other prior art systems combined a thermal type oxidizer integrally within the dryer enclosure, also utilizing volatile off-gases from the web material as fuel. However, this so-called straight thermal combustion system did not utilize any type of heat recovery device or media and required relatively high amounts of supplemental fuel, especially in cases of low volatile off-gas concentrations. Still other prior art apparatus combined a flotation dryer with the so-called thermal recuperative type oxidizer in a truly integrated fashion. One disadvantage of these systems is the limitation of heat recovery effectiveness due to the type of heat exchanger employed, thus preventing extremely low supplemental fuel consumption capabilities and often precluding any auto-thermal operation. This limitation in effectiveness results from the fact that a heat exchanger with high effectiveness will preheat the incoming air to temperatures high enough to cause accelerated oxidation of the heat exchanger tubes which results in tube failure, leakage, reduction in efficiency and destruction of the volatiles. In general, the thermal recuperative type device has a reduced reliability of system components such as the heat exchanger and burner due to the exposure of metal to high temperature in-service duty.

Yet another fully integrated system utilizes a catalytic combustor to convert off-gases and has the potential to provide all the heat required for the drying process. This type system can use a high effectiveness heat exchanger because the presence of a catalyst allows oxidation to occur at low temperatures. Thus, even a high efficiency heat exchanger can not preheat the incoming air to harmful temperatures. However, a catalytic oxidizer is susceptible to catalyst poisoning by certain components of the off-gases, thereby becoming ineffective in converting these off-gases to harmless components. Additionally, catalytic systems typically employ a metal type heat exchanger for primary heat recovery purposes, which have a limited service life due to high temperature in-service duty.

For example, U.S. Pat. No. 5,207,008 discloses an air flotation dryer with a built-in afterburner. Solvent-laden air resulting from the drying operation is directed past a burner where the volatile organic compounds are oxidized. At least a portion of the resulting heated combusted air is then recirculated to the air nozzles for drying the floating web.

U.S. Pat. No. 5,210,961 discloses a web dryer including a burner and a recuperative heat exchanger.

EP-A-0326228 discloses a compact heating appliance for a dryer. The heating appliance includes a burner and a combustion chamber, the combustion chamber defining a U-shaped path. The combustion chamber is in communication with a recuperative heat exchanger.

In view of the high cost of the fuel necessary to generate the required heat for oxidation, it is advantageous to recover as much of the heat as possible. To that end, U.S. Pat. No. 3,870,474 discloses a thermal regenerative oxidizer comprising three regenerators, two of which are in operation at any given time while the third receives a small purge of purified air to force out any untreated or contaminated air therefrom and discharges it into a combustion chamber where the contaminants are oxidized. Upon completion of a first cycle, the flow of contaminated air is reversed through the regenerator from which the purified air was previously discharged, in order to preheat the contaminated air during passage through the regenerator prior to its introduction into the combustion chamber. In this way, heat recovery is achieved.

U.S. Pat. No. 3,895,918 discloses a thermal rotary regeneration system in which a plurality of spaced, non-parallel heat-exchange beds are disposed toward the periphery of a central, high-temperature combustion chamber. Each heat-exchange bed is filled with heat-exchanging ceramic elements. Exhaust gases from industrial processes are supplied to an inlet duct, which distributes the gases to selected heat-exchange sections depending upon whether an inlet valve to a given section is open or closed.

It would be desirable to take advantage of the efficiencies achieved with regenerative heat exchange in air flotation dryers. However, a number of features are required for the successful and reliable operation of a dryer with an integrated regenerative style oxidizer, including meeting dimensional requirements, and the capability of handling a large percent of the high temperature (1600–2000° F.) airflow through the combustion chamber to be directed into the dryer enclosure rather than an outgoing heat exchanger.

The present invention satisfies the aforementioned requirements, and meets the drying, pollution and finishing requirements of a heat set web offset printing press.

SUMMARY OF THE INVENTION

The problems of the prior art have been overcome by the present invention, which provides an integrated web dryer and regenerative heat exchanger, as well as a method of drying a web of material using the same. The apparatus and method of the present invention provides for the heating of air and the converting of VOCs to harmless gases in a fully integrated manner via the inclusion of a regenerative combustion device as an integral element of the drying apparatus. In one embodiment, the dryer is an air flotation dryer equipped with air bars that contactlessly support the running web with heated air from the oxidizer. The dryer portion of the apparatus is preferably comprised of two process zones with one to two modules each.

DETAILED DESCRIPTION OF THE INVENTION

Figure 1:
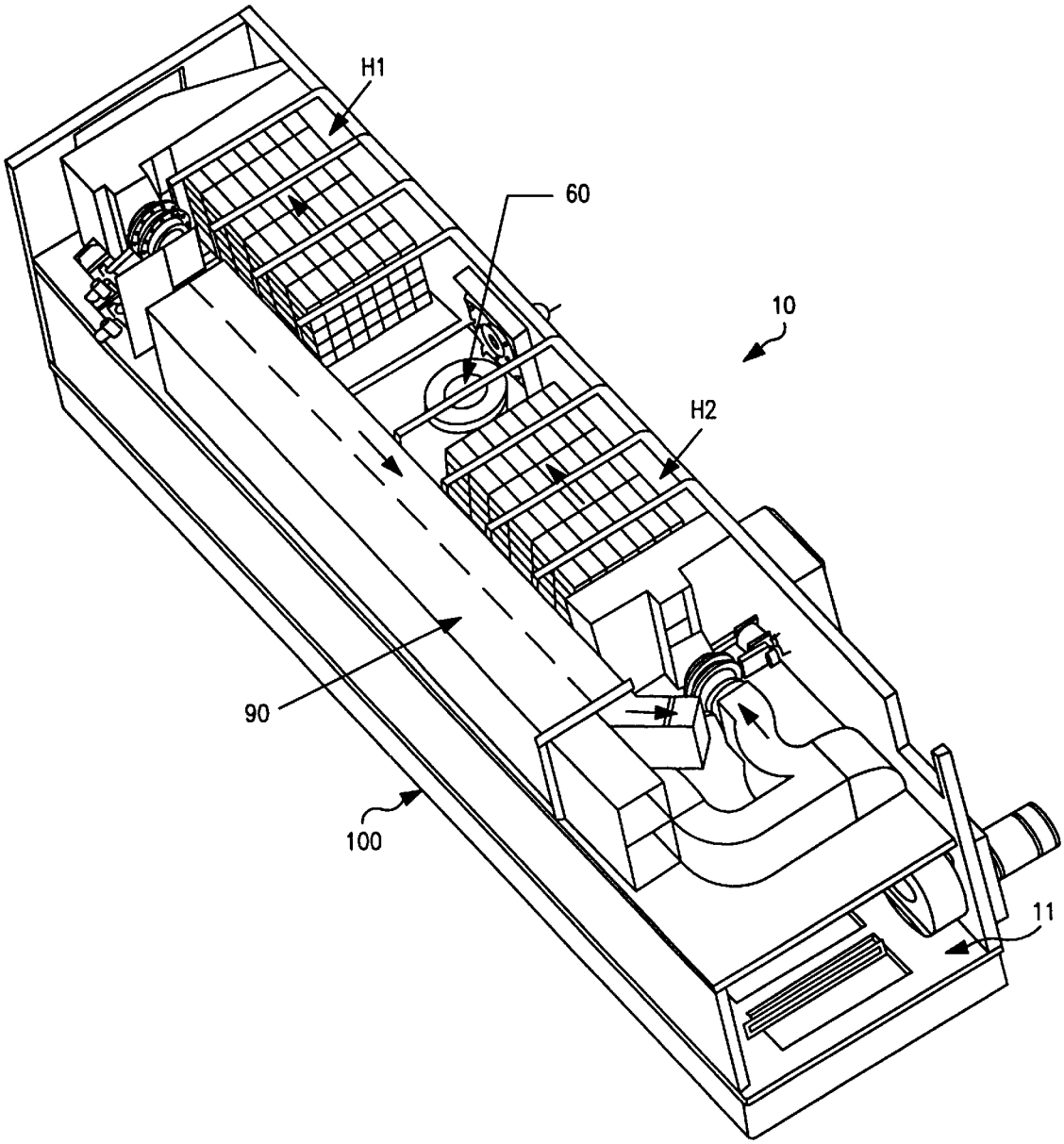
FIG. 1 is a perspective view of a preferred embodiment of the integrated dryer apparatus of the present invention.
Figure 2:
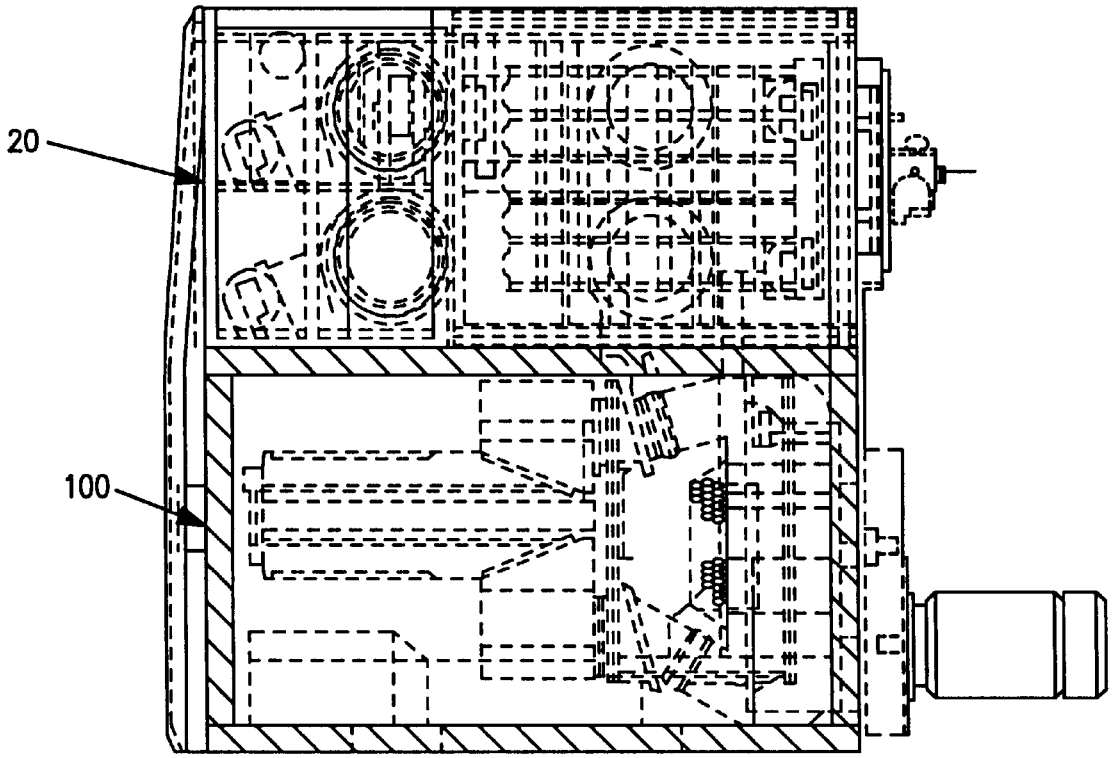
FIG. 2 is a cross-sectional view of a preferred embodiment of the integrated dryer apparatus of the present invention.
Figure 13:
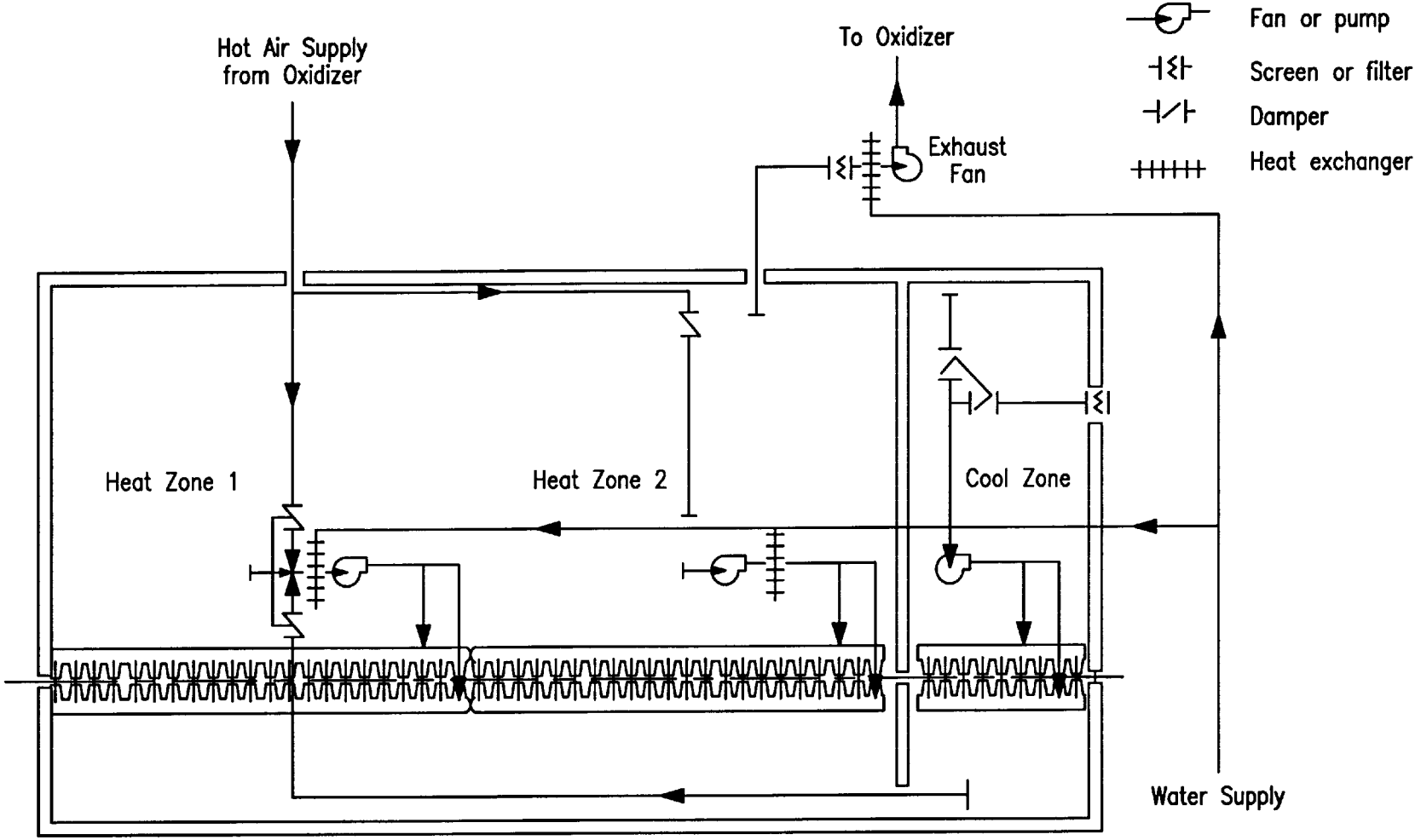
FIG. 13 is a schematic representation of the evaporation system in accordance with one embodiment of the present invention.

Turning first to FIGS. 1 and 2, there is shown at 10 an air flotation dryer 100 with an integrated regenerative thermal oxidizer 20. The flotation dryer 100 is an insulated housing that includes a web inlet slot 11 and web outlet slot (not shown) spaced from the web inlet slot 11, through which a running web is driven. In the dryer, the running web is floatingly supported by a plurality of air bars (FIG. 13). Although preferably the air bars are positioned in staggered opposing relation as shown, those skilled in the art will recognize that other arrangements are possible. To achieve good flotation and high heat transfer, HI-FLOAT® air bars commercially available from MEGTEC Systems are preferred, which float the web in a sinusoidal path through the dryer. Enhanced drying can be achieved by incorporating infrared heating elements in the drying zone, and/or using a combination of air bars that utilize the Coanda effect and hole bars. This latter configuration is preferred, wherein a series of hole bars provide thermal transfer while alternately placed HI-FLOAT® Coanda-type air bars provide stable web flotation, guidance and additional heat and mass transfer. Such a system is commercially available from MEGTEC SYSTEMS under the name "DUAL-DRY". The upper and lower sets of air bars are in communication with respective headers, each of which receives a source of heated air via supply fan, and directs it to the respective air bars. A make-up air damper or fan can be provided in communication with the fan to supply make-up air to the system where necessary. Those skilled in the art will appreciate that although a flotation dryer is illustrated, dryers where contactless support of the web is not necessary are also encompassed within the scope of the present invention.

In the preferred embodiment, the dryer portion of the unit is comprised of two process zones with one or two modules each (as used herein, a module is defined as one header/fan/plenum combination). In the first zone, the web temperature increases rapidly and solvent evaporation begins. The web temperature is controlled by introduction and regulation of the amount of hot air from the combustion chamber or combustion zone of the oxidizer (discussed in greater detail below). In operation, typically only the first module of the first zone is heated, although the second module of the first zone can have additional heat if required. In the first module of the second zone, solvents continue to evaporate in substantial quantities and are removed and delivered to the oxidizer with an exhaust fan or similar means. Preferably all circulation air from the second zone internally cascades from the first zone and no additional heat is available from the oxidizer.

Preferably the supply fan for the first module in the first zone utilizes a two-speed motor to enable low speed operation during hot idle. Supply fans for all other modules utilize single speed motors.

Two main airflow patterns exist within the dryer: the re-circulating (cross machine direction) air and the make-up/exhaust air (machine direction). Each air re-circulating module creates the re-circulating air pattern. The first module of the dryer is where the majority of the thermal energy required for drying enters the web. This is supplied through the primary hot air damper, which is located above the hot air mixing box 70. In drying cases where more thermal energy is required than can be supplied by the first module, heat can be added to the web in the second module from a secondary heat damper. The second zone is a dwell zone, where no additional thermal energy is added to the web, other than that which has internally cascaded through the dryer enclosure 100.

The regenerative oxidizer 20 that is integrated with the dryer 100 is preferably a two-column oxidizer. Most of the components of the oxidizer 20 are mounted above the dryer enclosure 100. Major components include the exhaust fan, heat exchanger, switching dampers, LEL analyzer, fuel gas injection unit, an entrapment chamber, and associated ductwork. Energy to the heat exchanger is supplied via a burner, fuel gas injection unit, and evaporated printing solvents from the dryer. The burner is used primarily during the initial heat up of the unit. The injection unit adds fuel (such as natural gas or propane) to the inlet of the exhaust fan to augment or maintain the desired bed temperature required for VOC destruction. Switching dampers direct the air along the required path in the heat exchanger and the oxidizer ductwork. Air accumulation tanks are mounted on the unit to ensure an adequate amount of compressed air is available for the switching dampers. The entrapment chamber collects the solvent-laden air that would otherwise be exhausted from the unit when the direction of air flow through the oxidizer is reversed. The "dirty" air in the entrapment chamber is then drawn back into the dryer by the exhaust fan.

More specifically, preferably there are two heat exchanger beds H1 and H2 positioned such that flow through each bed is substantially horizontal. With regenerative thermal oxidation technology, the heat transfer zones in each column must be periodically regenerated to allow the heat transfer media (generally ceramic monolith for horizontally arranged heat exchangers) in the depleted energy zone to become replenished. This is accomplished by periodically alternating the heat transfer zone through which the cold and hot fluids pass. Thus, when the hot fluid passes through the heat transfer matrix, heat is transferred from the fluid to the matrix, thereby cooling the fluid and heating the matrix. Conversely, when the cold fluid passes through the heated matrix, heat is transferred from the matrix to the fluid, resulting in cooling of the matrix and heating of the fluid. Consequently, the matrix acts as a thermal store, alternately accepting heat from the hot fluid, storing that heat, and then releasing it to the cold fluid.

Figure 3:
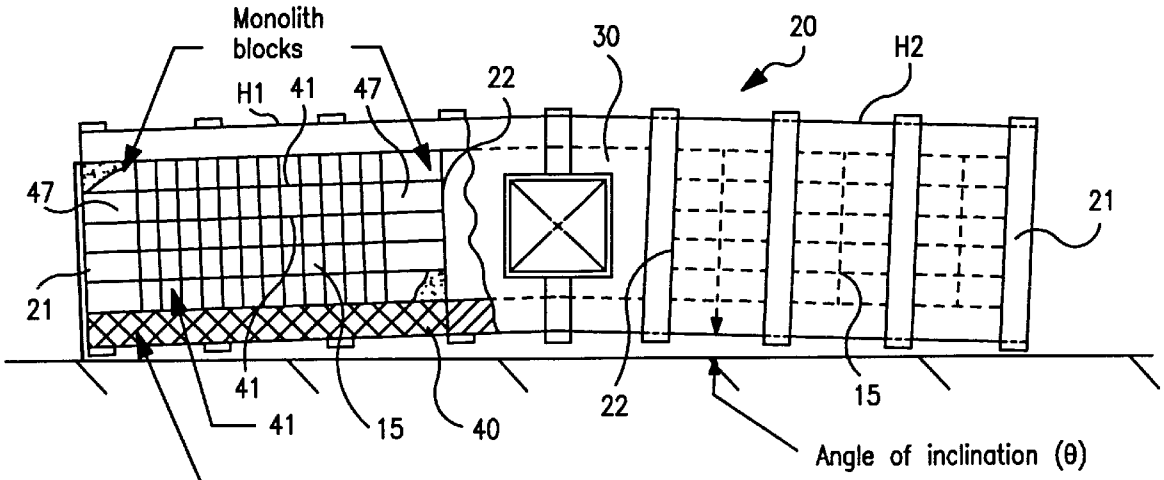
FIG. 3 is a cross-sectional view of a horizontal regenerative thermal oxidizer in accordance with the present invention.

Configuring the heat exchange beds in a horizontal manner meets tight dimensional constraints. The horizontal arrangement, however, requires careful attention to the flow distribution, heat exchange media support and heat exchange media restraint. High drag forces generated by high temperature at the hot end of the bed and the impulse force generated by valve switching during cycle change can cause deleterious movement of monolithic heat exchange media blocks. The problem can be eliminated by fixing the blocks in place such as by cementing with refractory grade mortar. However, since mortar can break down over time, the preferred method for eliminating this problem is by angling the beds as shown in FIG. 3. This allows a component of the gravity force on the media to oppose the drag and impulse forces.

More specifically, each heat exchanger includes a cold end 21 and a hot end 22. The cold end 21 serves as an inlet for relatively cool process gas containing VOC's to be oxidized, or as an outlet for relatively cool process gas whose VOC's have been oxidized, depending upon the cycle of the oxidizer at any given time. Spaced from each cold end 21 is a hot end 22, which in each case is nearest the combustion zone 30. Between the cold end 21 and hot end 22 of each heat exchanger, a matrix of refractory heat exchange media is placed. In the preferred embodiment, the matrix 15 of heat exchange media is one or more monolithic blocks, each having a plurality of defined vapor flow passages. The heat exchange columns are arranged on opposed sides of the combustion zone 30 such that axial gas flow passages in the heat exchange media in one of the columns extends in a direction towards the other column. Most preferably, the matrix 15 consists of a plurality of stacked monolithic blocks, the blocks being stacked such that their vapor flow passages are axially aligned, thereby allowing process gas flow from the cold end of each bed to the hot end of each bed, or vice versa. Monolithic structures suitable for the matrix 15 include those having about 50 cells/in$^2$ and allowing for laminar flow and low pressure drop. Such blocks have a series of small channels or passageways formed therein allowing gas to pass through the structure in predetermined paths, generally along an axis parallel to the flow of gas through the heat exchange column. More specific examples of suitable monolithic structures are mullite ceramic honeycombs having 40 cells per element (outer dimensions 150 mm×150 mm) commercially available from Frauenthal Keramik A. G.; and monolithic structures having dimensions of about 300 mm×150 mm×150 mm commercially available from Lexco as MK10. These blocks contain a plurality of parallel channels.

In order to counter the drag forces that are encountered especially at the hot end 22 of each of the heat exchange columns, the matrix 15 of media is angled slightly above the horizontal as shown in FIG. 3. The angle is most profound at the hot end of the exchangers where the drag forces are the most significant. Suitable angles are from about 1 to about 10 degrees of horizontal, with an angle of from about 1 to 5 degrees being preferred, and an angle of about 1.6 degrees being most preferred for a bed six feet in length. The resulting angle of 1.6 degrees is the preferred angle in such a system to minimize the height of the unit. The magnitude of the gravitational force for the conditions given will be larger than the expected drag force. This opposing force will not deteriorate over time. Those skilled in the art will appreciate that determination of the optimum angle of incline will depend in part on the material density of the particular matrix for a given channel count per inch and flow rate. Less dense materials need more inclination. Preferably the angle of inclination is constant over the length of the matrix. That is, the height of the matrix preferably increases (relative to the substrate supporting it) uniformly from the cold end to the hot end of the column.

Figure 4:
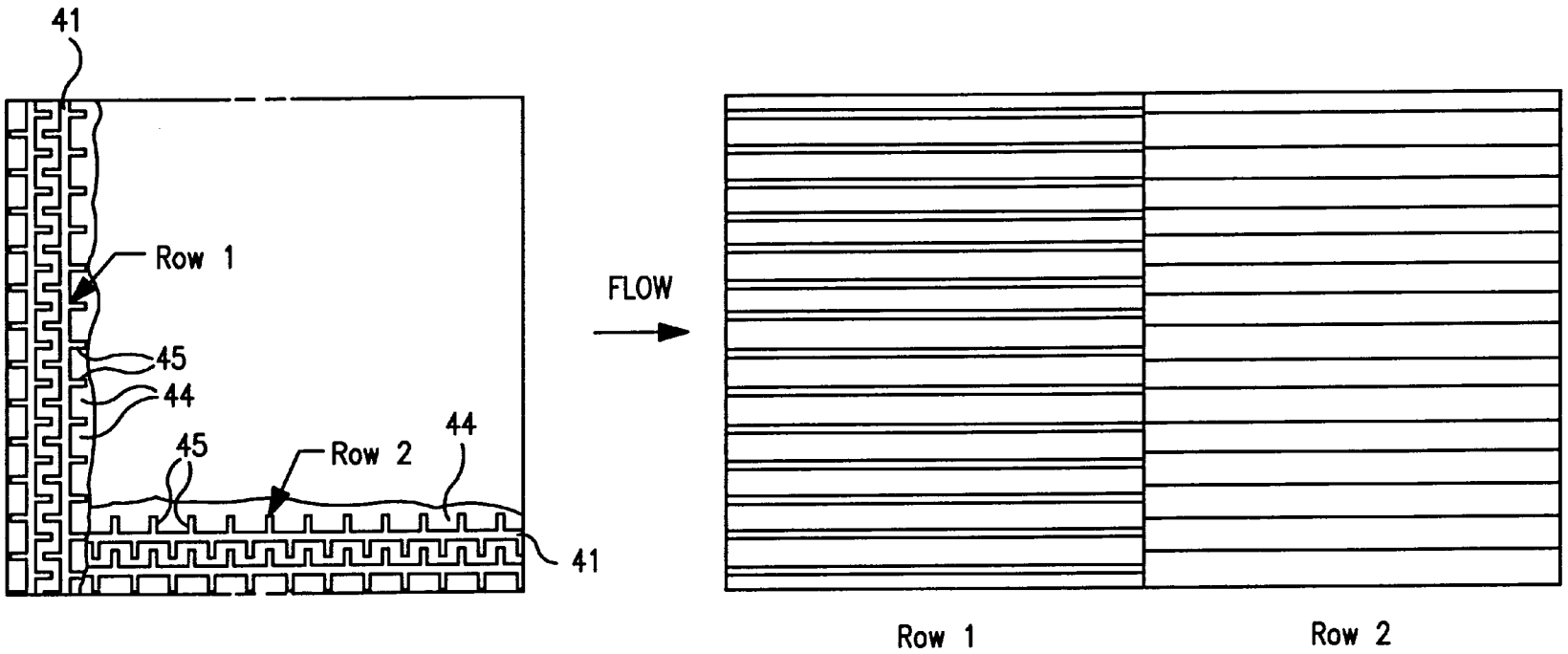
FIG. 4 is a cross-sectional view of the heat exchange matrix of one embodiment of the present invention.

In the embodiment shown for heat exchange bed H1 in FIG. 3, the matrix 15 is multi-layer and includes a stack of ceramic (or other heat refractory material) preferably planar plates 41 having a plurality of parallel ribs 45 (FIG. 4). The plates 41 are stacked, and thus the ribs 45 extending from each plate 41 are interleaved so as to form parallel grooves 44 therebetween. The ribs 45 extend from a surface of each plate 41, and the outer ends of each rib 45 contact an opposing surface of an opposing plate 41. The formed grooves 44 are wider than the opposed rib and about the same height as the ribs. Such media is commercially available from Lantec Products, Inc. and is disclosed in U.S. Pat. No. 5,851,636, the disclosure of which is hereby incorporated herein by reference. Preferably the stack of plates is preferably enveloped between one or more stacks of monolithic blocks 45 at the cold end 21 and one or more stacks of monolithic blocks 45 at the hot end 22 of the heat exchange bed. The stacks of monolithic blocks help stabilize and secure the stack of plates 41. A gap between the stack 45 of monolithic blocks and the stack of plates 41 may be provided in order to ensure uniform distribution of the process gas as it flows from the axial flow passages in the monolithic blocks toward the channels formed in the stack of plates 41. Firebrick insulating support 46 can be provided to support the stack of plates 41.

The method of forming the suitable angle is not particularly limited; the angle can be formed by creating an angled floor 40 in the heat exchange column, or by supporting the matrix on one or more suitable supports, for example. As a result of the angle, a component of the weight of the matrix can resist the drag force generated and prevent movement of the matrix during operation of the oxidizer.

Figure 3A:
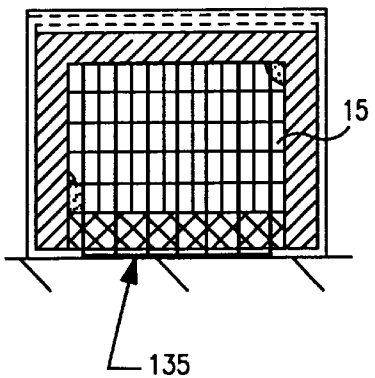
FIG. 3A is an end view of a horizontal regenerative thermal oxidizer in accordance with one embodiment of the present invention.
Figure 3B:
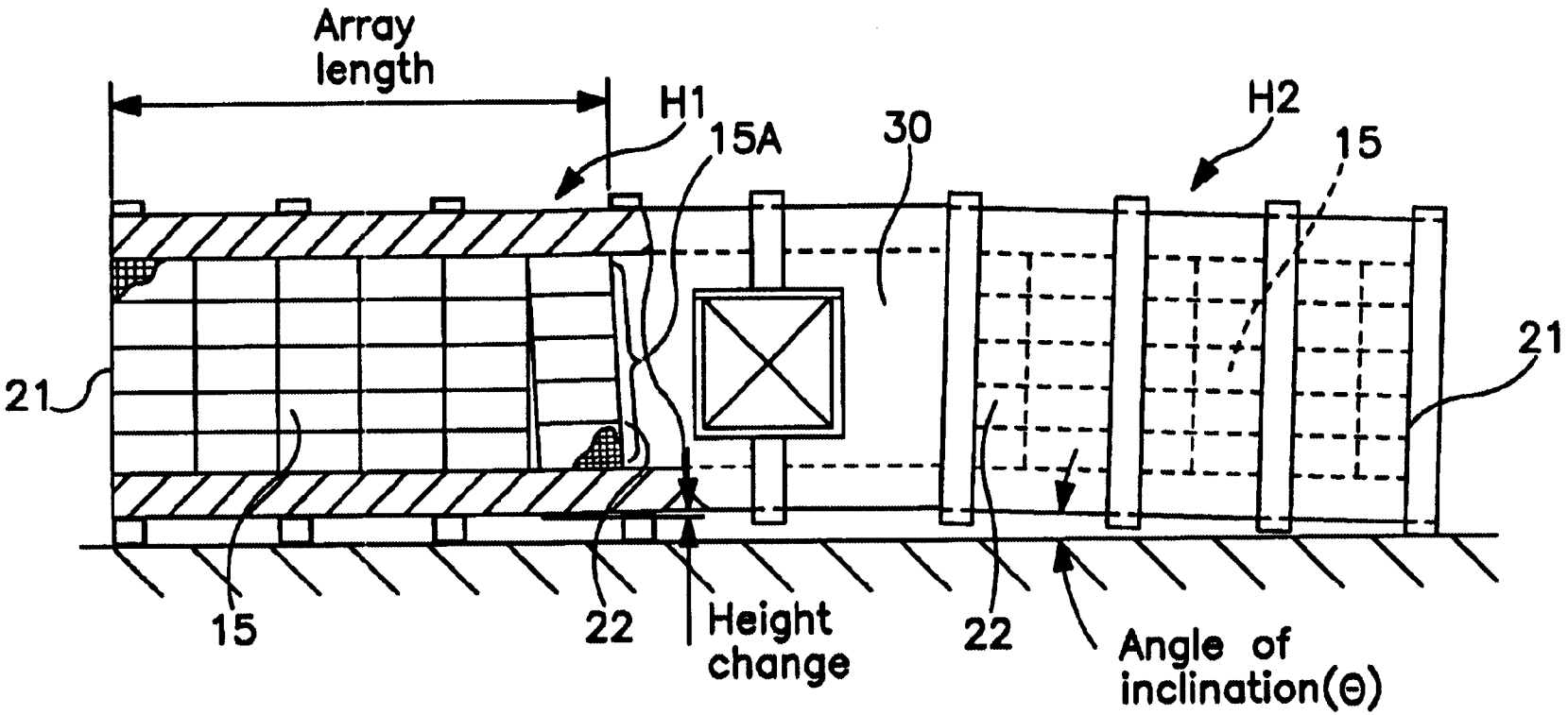
FIG. 3B is a cross-sectional view of another embodiment of a horizontal regenerative thermal oxidizer in accordance with the present invention.

In the event that the cold side of the matrix requires restraint, a wire mesh or steel grid of high open area (50%–90%) can be used, since the high temperatures encountered on the hot side are not encountered on the cold side, and degradation of these restraining materials is not problematic. Such an option is illustrated in FIG. 3A, where steel grid 35 is shown supporting the matrix 15.

Horizontal arrangement requires that the media be supported. Since the temperature of the media may exceed 2000° F. at times in some locations, insulating material is needed to support the media. The insulating material must provide adequate insulation within the height available in the bed, and also have the strength and shrinkage resistance to prevent the formation of bypass paths for the air flow. Suitable material generally has high alumina content, preferably greater than 35%. Insulating firebrick with high alumina content, such as BNZ 2300 or lightweight castable refractory material with high alumina content such as Harbison-Walker lightweight castable 26 is preferred.

When the matrix 15 includes monolithic blocks, non-uniform flow distribution on the oxidation process can be problematic. Since the monolith blocks are essentially a continuous passage from cold end to hot end of the bed, any distribution problems at the entry to the bed will persist through to the outlet. If the distribution problem is severe, low temperature regions in the bed can occur. These areas can fall below the temperature required for oxidation of the solvent or fuel gas supplied to the bed and decrease the efficiency of the apparatus or collapse the temperature profile, rendering the unit inoperable. To prevent this problem from occurring, a poor inlet profile can be corrected by using structured media consisting of finned plates as shown in FIG. 4 and as described above. These plates can be arranged to alternately allow the redistribution of flow in both the vertical and horizontal directions.

Since the plates 41 are more difficult to restrain than monolith blocks, preferably monolith blocks 47 are positioned at the entering and leaving ends of the beds as shown in FIG. 3 in order to restrict movement of the plates 41. This arrangement also allows the use of plates made of a higher heat capacity material such as mullite which may not be as durable as the material commonly used for the monolith blocks (cordierite). In addition, the plate material 41 has a cost advantage over the monolith blocks.

Figure 5:
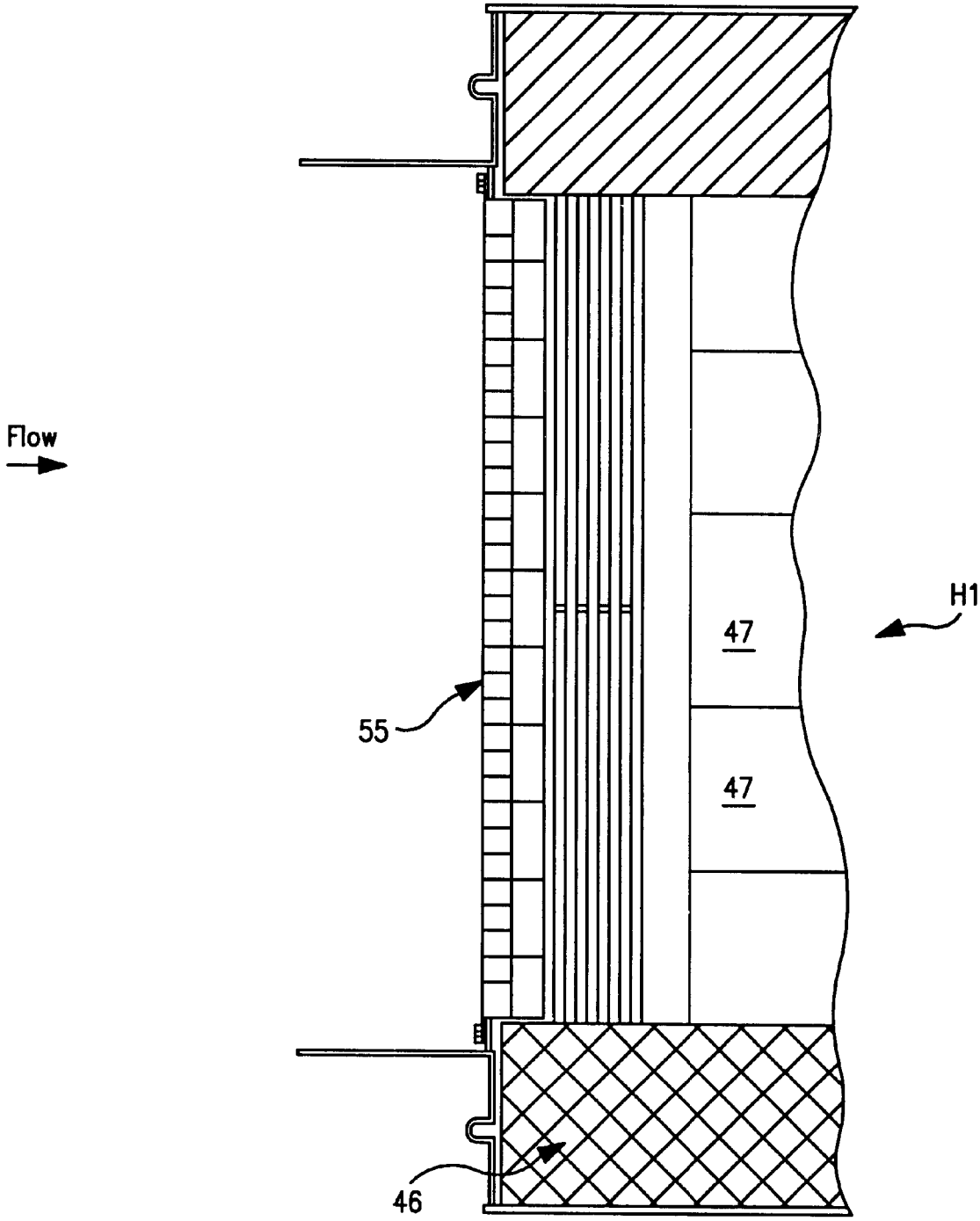
FIG. 5 is a cross-sectional view of the flow distributor assembly in accordance with the present invention.
Figure 6A:
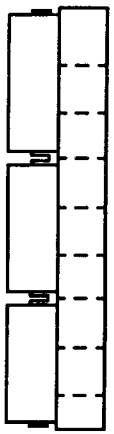
FIGS. 6 and 6A ares top and side views of the flow straightening assembly in accordance with the present invention.
Figure 6:
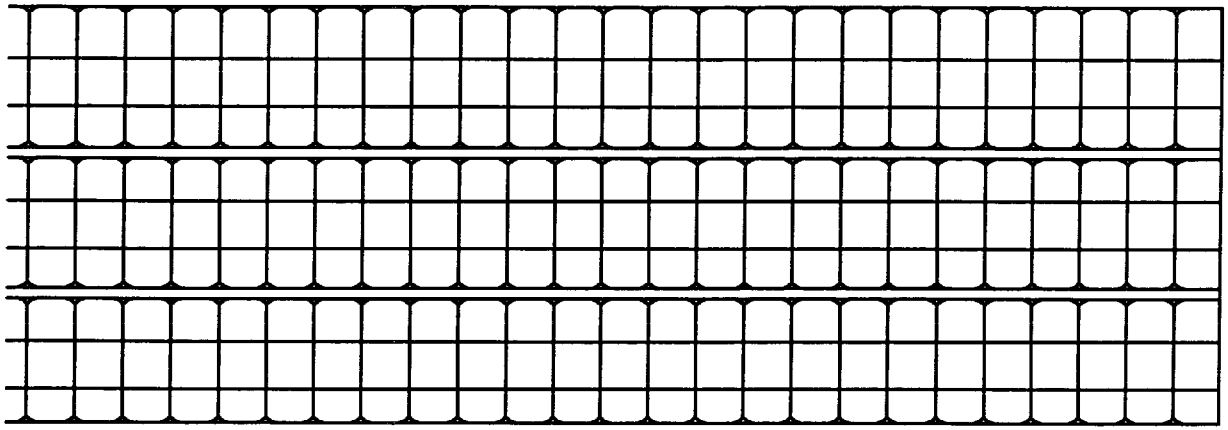
Figure 7A:
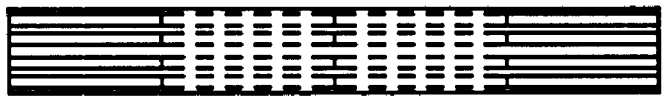
FIGS. 7 and 7A are top and side views of the perforated plate assembly in accordance with the present invention.
Figure 7:
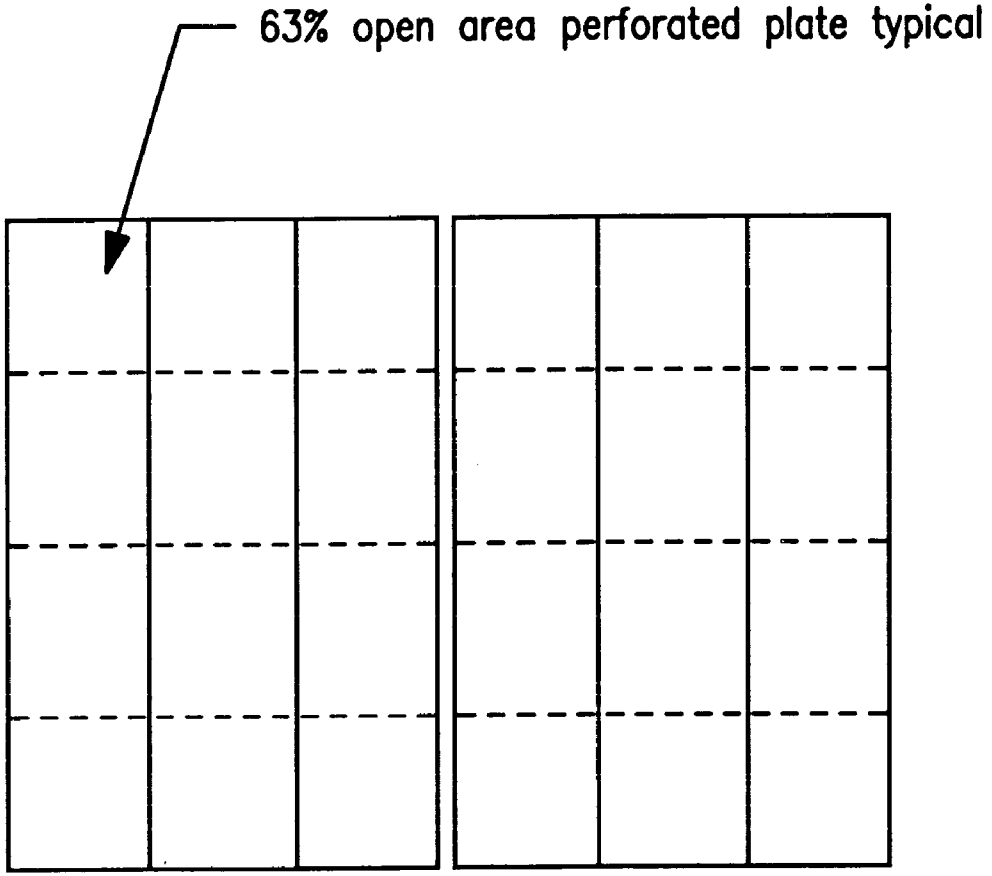

Alternatively or in addition, another approach to eliminate the flow distribution skew is a compact, low-pressure drop flow distributor 50 shown in FIG. 5. The flow distributor 50 includes a flow straightening section and a series of perforated plates or screens. The flow straighteners 55 are shown in FIG. 6. Two layers oriented at 90° to each other are used to allow redirection of air flow in two directions. Multiple layers of perforated plates of at least 40% open area are used. The preferred arrangement has 9 layers of 63% open area perforated plates (FIG. 7) with a combined depth of 6 inches.

Figure 8:
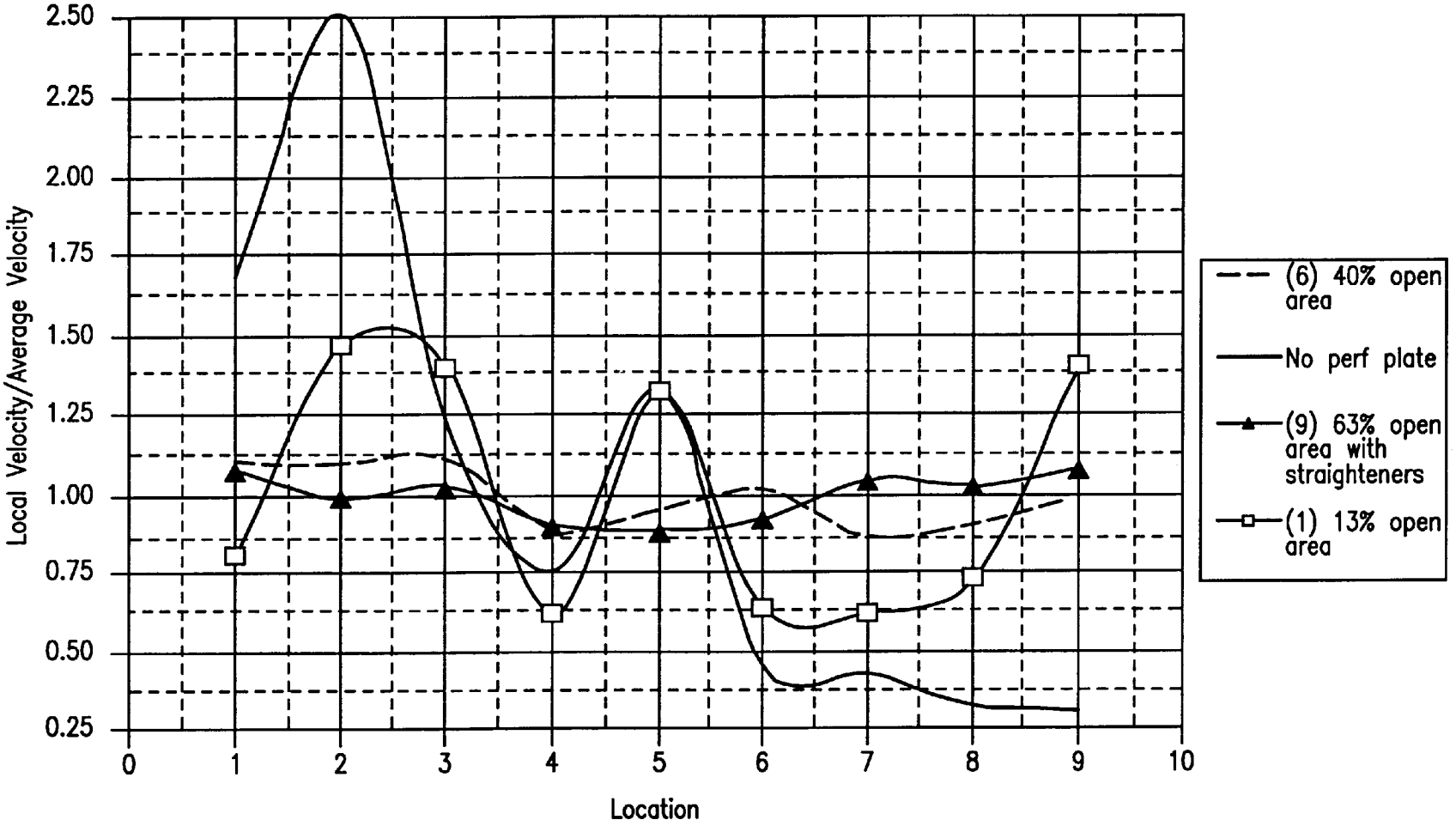
FIG. 8 is a graph showing flow distribution.
Figure 9:
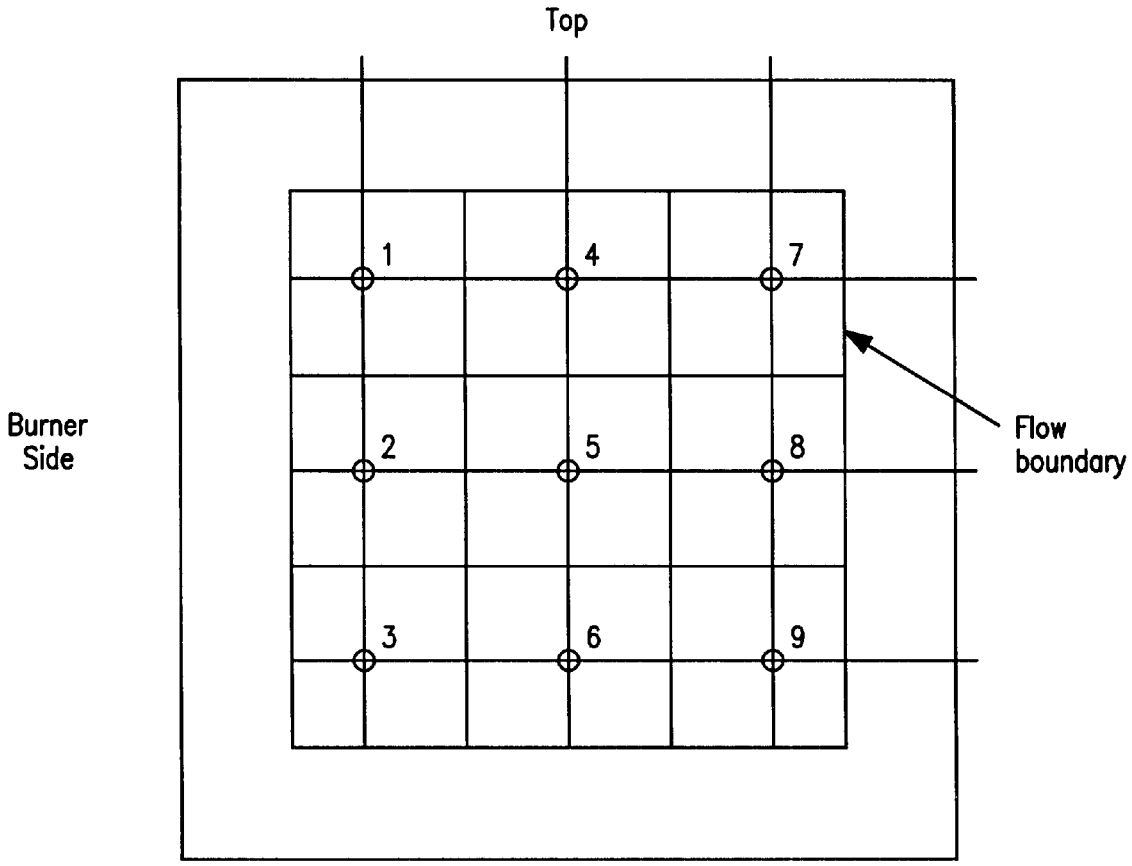
FIG. 9 is a chart showing the locations for measurement of the flow distribution shown in FIG. 8.
Figure 10D:
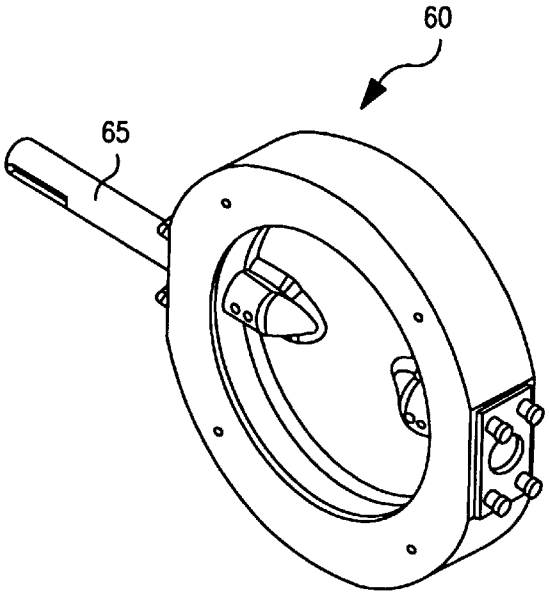
FIGS. 10A–10D are perspective views of the high temperature damper assembly in accordance with the present invention.
Figure 10A:
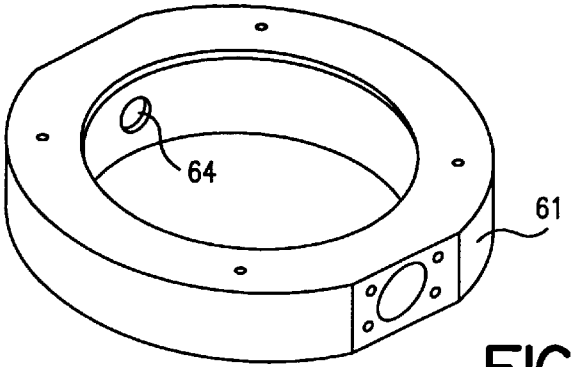
Figure 10B:
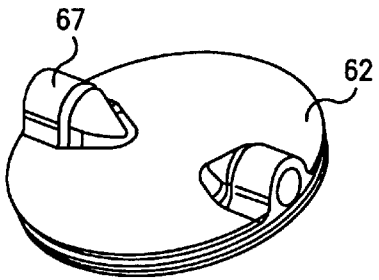
Figure 10C:
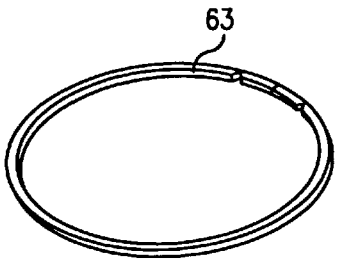

FIG. 8 illustrates the performance of various flow distributor embodiments, with the location of the measurements used to generate the data of FIG. 8 being shown in FIG. 9. The velocity distribution without a flow distributor is also shown. For an end fed bed as shown in FIG. 1, one side of the heat exchange bed receives most of the flow if no distributor is used. A single perforated plate of 13% open area results in a velocity variation from the average of about ±50%. Using six plates of 40% open area results in a distribution of less than ±15%. To achieve less than ±10% variation, the arrangement of nine plates of 60% open area plus flow straighteners is required. The multiple-plate device is suitable for many applications without significant redesign or testing. It has about 25% of the pressure drop of the more restrictive single plate of 13% open area. For example, for a velocity of about 600 fpm, the pressure drop was approximately 0.1 in wg at 70° F. air temperature for the device of FIG. 5.

In order to optimize the thermal efficiency and stability of the oxidizer, the flow direction through the heat exchanger is reversed at controlled intervals by switching dampers. The switching dampers direct air along a path in the oxidizer ductwork and through the heat exchanger. Pneumatic cylinders are used to actuate butterfly dampers and reverse flow. Limit switches on each damper ensure that it is correctly positioned at all times. Switching dampers also control the airflow through the entrapment chamber 90.

Figure 14:
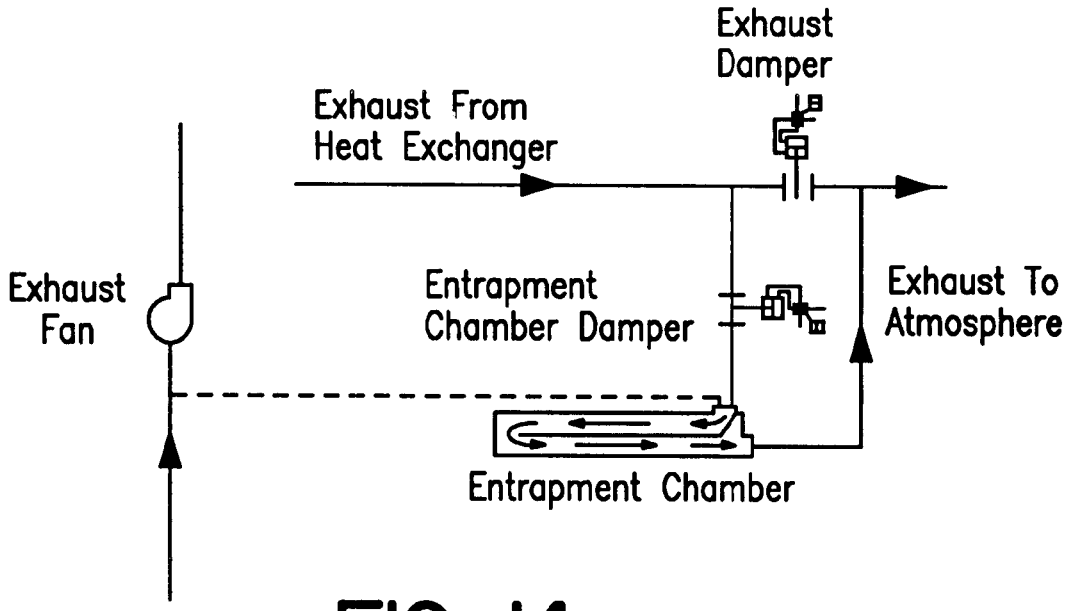
FIG. 14 is a schematic representation of the entrapment chamber function in accordance with the present invention.

During flow reversal through the heat exchanger, a small amount of uncleaned or "dirty" process air does not complete the oxidation cycle. This "puff" of dirty air is diverted to the entrapment chamber 90 to prevent it from being exhausted to atmosphere. More specifically, during a flow reversal through the heat exchanger, the exhaust damper is closed simultaneously as the entrapment chamber 90 damper is opened. This diverts the small amount of dirty air into the entrapment chamber 90. After a short period of time, determined in the PLC based upon actual volumetric exhaust flow, the entrapment chamber damper is closed and the exhaust damper is simultaneously opened. The exhaust fan then begins to "clean" the entrapment chamber 90 by pulling the dirty air out of the chamber and exhausting it back into the oxidizer. Clean air from the oxidizer exhaust is drawn into the entrapment chamber 90 to replace the dirty air that is being drawn into the exhaust fan. This flow is set with a manual trim damper to clear out the entrapment chamber 90 just in time for the next switch (excessive exhaust results in wasted energy and insufficient dryer exhaust). This clean air is exhausted out of the exhaust stack to atmosphere during the next filling of the entrapment chamber 90 with dirty air. This scheme is shown schematically in FIG. 14.

Air from the dryer enclosure 100 containing evaporated ink solvents is delivered via an exhaust fan to the oxidizer. Air to replace the removed exhaust is drawn in through an opening in the top of the dryer enclosure 100 and through the web slots, which prevents evaporated solvents from escaping to ambient. The exhaust rate is selected to ensure the concentration of solvent in the dryer remains below a predetermined value, such as 35% of the lower explosion limit (LEL). For example, the exhaust fan can be electronically controlled with a variable frequency drive, minimizing consumption of fuel for heating up incoming fresh air. Mass flow sensors can be located at the inlet of the exhaust fan to measure the exhaust fan flow. An LEL monitor can be used to continuously monitor the solvent concentration of the exhaust and insure that it remains below the predetermined value.

A transfer fan housed in fan housing 66 (FIG. 11) can be used to assist the exhaust fan in drawing make-up air into the dryer, and thereby controlling the air entering the dryer enclosure 100 through the web opening slots. The transfer fan speed is varied to maintain a constant dryer enclosure negative pressure. Incoming fresh air is mixed with internal circulation air and with hot combustion chamber air from the oxidizer.

The dryer operation requires a relatively large percentage (30 to 50%) of the very high temperature (1600° F. to 2000° F.) air in the combustion chamber 30 of the oxidizer 20 to be directed into the dryer enclosure rather than the out-going heat exchanger H1 or H2. The extremely high temperature of the air diverted from the combustion chamber 30 requires a specially designed valve, which is shown in FIGS. 10A through 10D. The valve 60 is a simplified damper cast of superalloy materials. The blade, ring, housing and shafting are not necessarily made of the same alloy. Because of temperatures which can reach 2500° F. at times, the iron-base superalloys are not preferred for the damper components. Rather, the housing, blade and shafting preferably use nickel-base superalloys with chromium content of 23 to 27% and nickel content of 32–45%, such as that commercially available as 25–35 Nb from Wisconsin Centrifugal. RA333 alloy is especially preferred for the shafting. The compression ring is preferably machined from a cobalt-base superalloy such as Stellite 31. The cobalt-base superalloys exhibit high temperature strength as well as excellent wear resistance. Wear resistance is important for the ring, as it experiences sliding contact during operation. The housing also encounters this sliding contact, however the wear is distributed over a larger area and therefore the nickel-based alloy is adequate. The nickel-base superalloys exhibit a strength advantage over iron-base superalloys in the 1600–2000° F. operating range of the oxidizer. Castings are used for the housing and blade because they have inherently fewer stress concentrations than a welded assembly. This improves the resistance to crack formation at high temperature operation. To retain the ring over the range of rotation of the blade (0–90°), a spherical housing profile is required on the inner surface of the housing. A slot is also required to insert the ring and blade during the assembly process.

The damper includes a housing 61 which is substantially cylindrical, a blade 62 and a sealing ring 63. The housing 61 includes an aperture 64 which receives rod 65 that is coupled to blade 62 through rod receiver 67. The rod 65 actuates the blade 62 in the housing 61. Sealing ring 63 seals the blade in the housing 61 when in the closed position. Preferably the parts of the damper 60 are cast in order to produce dimensionally consistent parts with few defects. Finishing and joining operations are minimal so fewer residual stresses and areas for stress concentration result in the assembly of the damper 60. This produces a valve that can tolerate a high temperature environment for long periods of time without failure.

The damper 60 can be controlled based on temperature in the dryer air bar header supply sensed with a thermocouple or the like. Based upon the sensed temperature of the supply air, a controller (such as a PLC) can be used to modulate the damper and control the air temperature by controlling the amount of air allowed to flow into the mixing chamber.

To supply energy to the dryer, the hot air damper 60 is in fluid communication with a chamber that mixes the combustion chamber 30 air with dryer make-up air. This chamber location in the dryer is shown in FIGS. 11, 12A, 12B and 12C. Thus, mixing chamber or box 70 includes an outlet aperture 71 through which air is fed into the dryer enclosure, and a make-up air inlet 72 (FIG. 12A) which allows fluid communication between make-up air ducting 73 and the mixing box 70. The mixing box 70 also can include an optional mounting 74 for a second zone damper. Preferably the mixing box 70 is constructed of 300 series stainless steel.

Figure 15A:
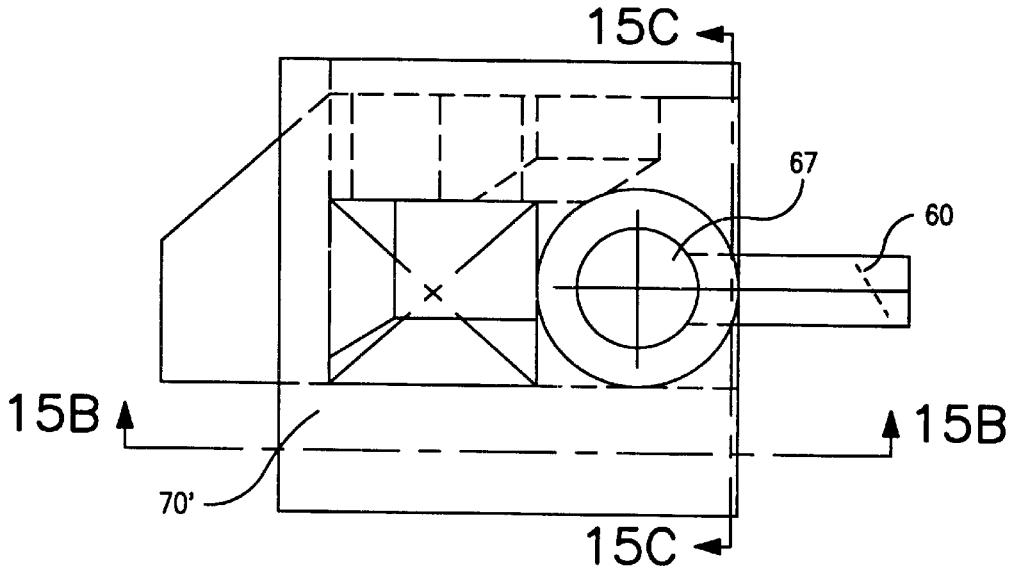
FIGS. 15A, 15B and 15C are views of an alternative design of the mixing box in accordance with the present invention.
Figure 15B:
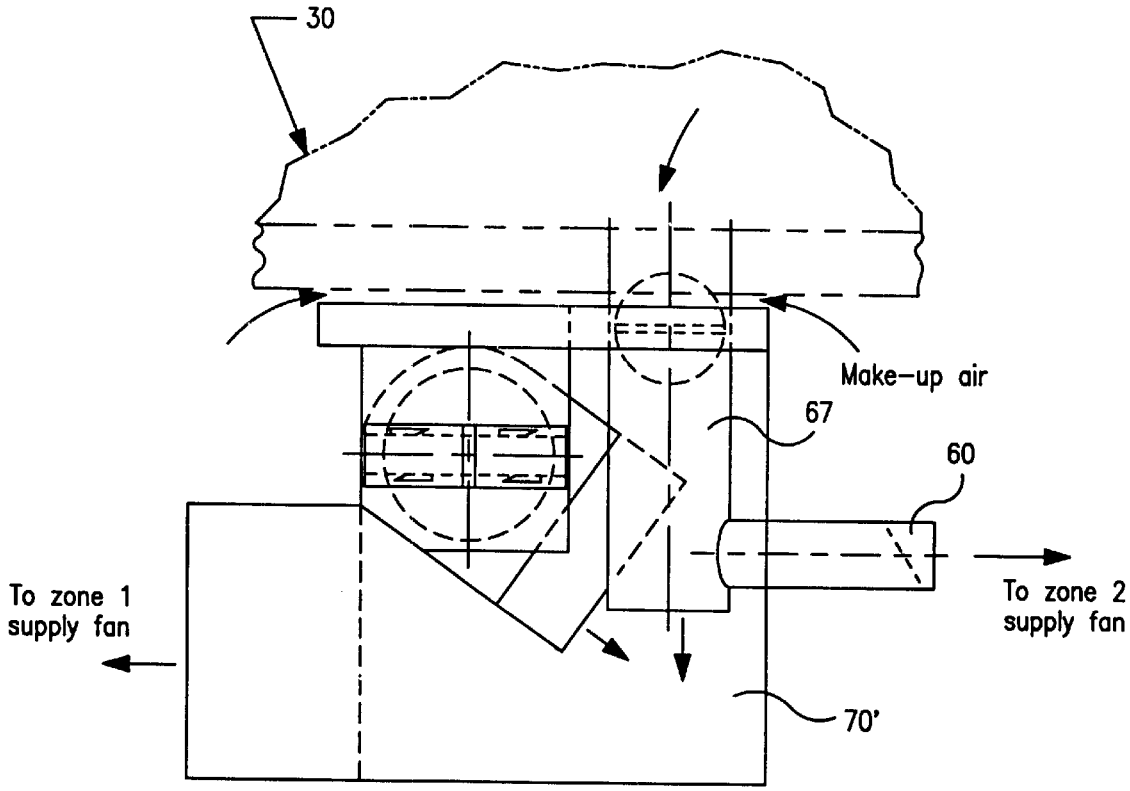
Figure 15C:
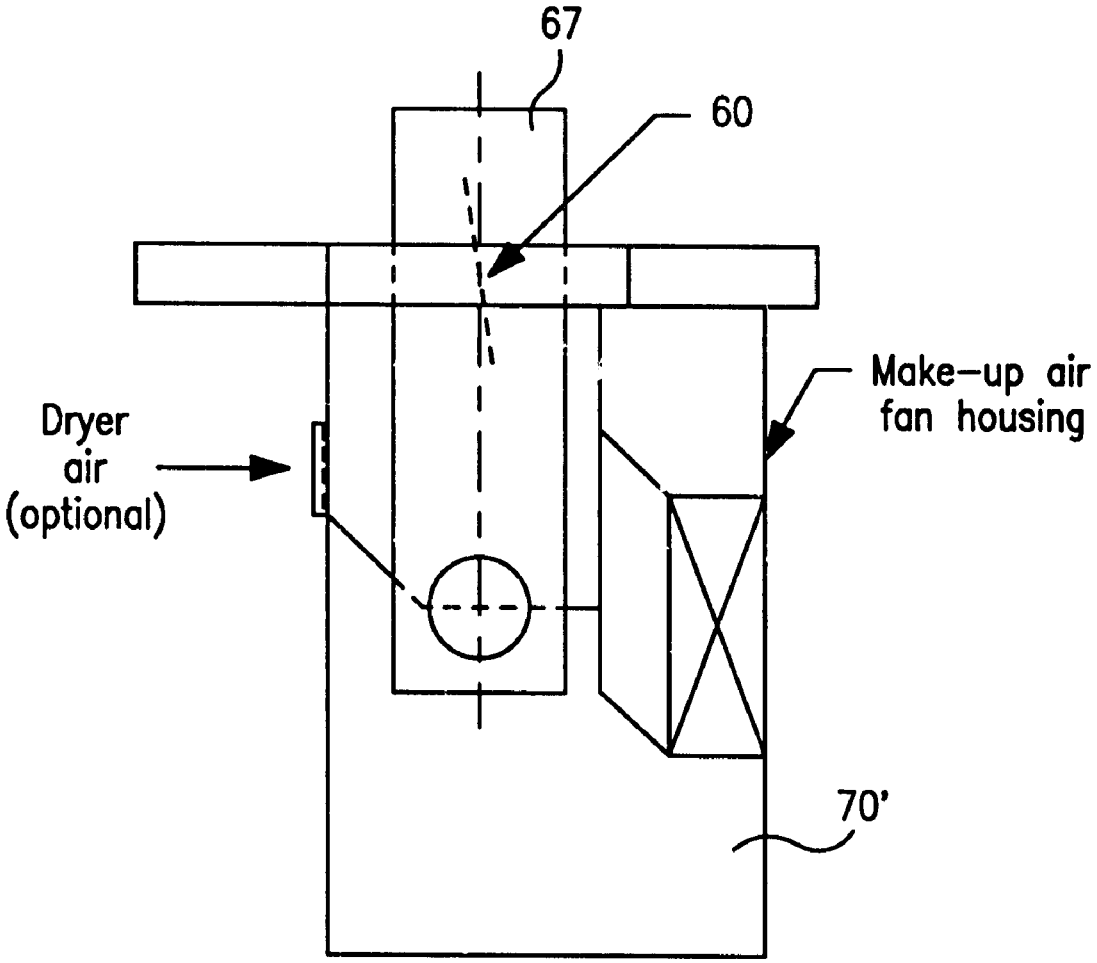

An alternative embodiment of the mixing box is shown in FIGS. 15A, 15B and 15C. Mixing box 70' draws make-up air from the region under the oxidizer combustion zone 30. The make-up air cools the sleeve 67 that provides communication between the combustion zone 30 and the hot air damper 60. This also eliminates a long make-up air duct. In addition, because the volume of make-up air is not always sufficient for good mixing, the mixing box 70' design includes an option 68 (FIG. 15C) to add dryer recirculation air to the make-up air fan.

Figure 11:
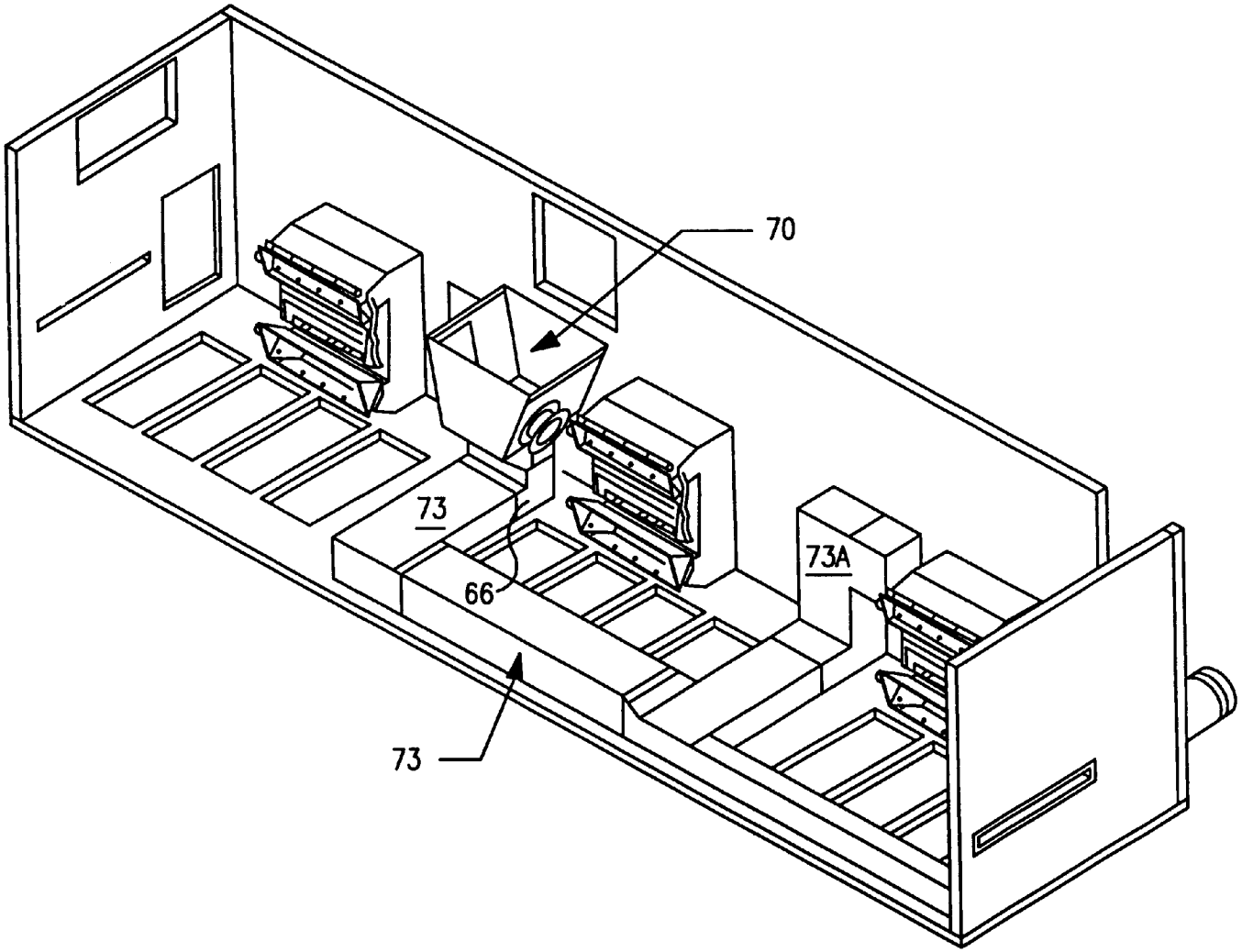
FIG. 11 is a perspective view showing the hot air mixing box arrangement in accordance with the present invention.
Figure 12A:
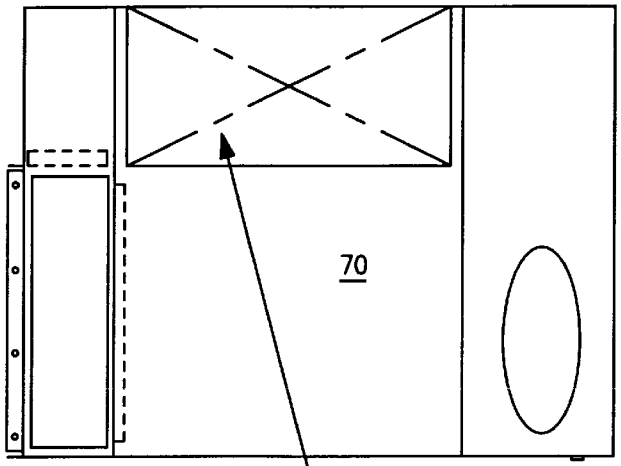
FIGS. 12A, 12B and 12C are views of the hot air mixing box in accordance with the present invention.
Figure 12B:
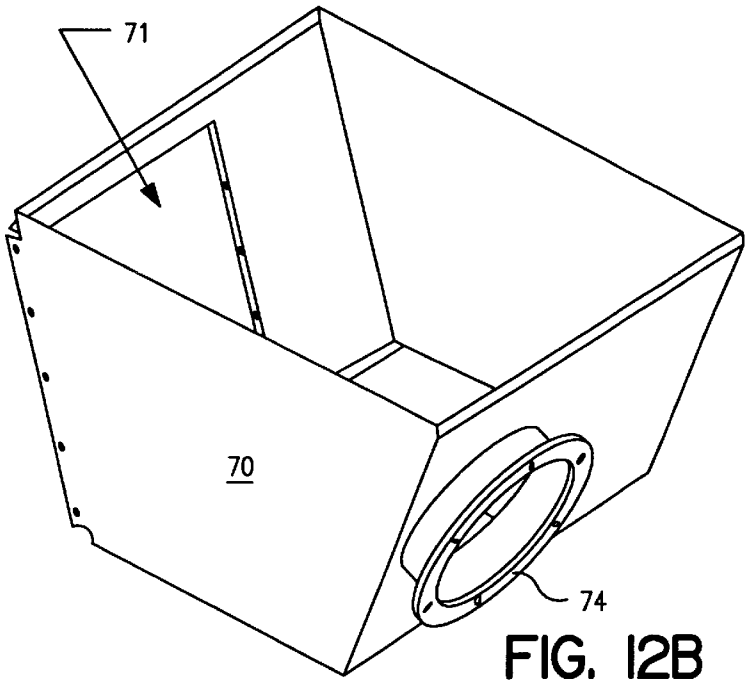
Figure 12C:
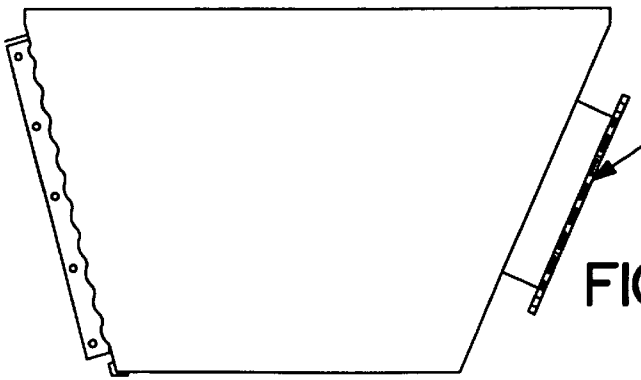

Make-up air is preferably provided by a variable speed transfer fan in order to eliminate the necessity for a damper to control the make-up air delivery. Preferably at least a portion of the make-up air is supplied from the region of the apparatus that encloses the oxidizer, as shown in FIG. 11 via suitable ductwork 73A. The oxidizer and ductwork that have cladding temperatures higher than ambient air preheat this air. The remainder of the make-up air enters the ducting 73 from ambient.

In the mixing chamber 70 (or 70'), the make-up air reduces the temperature of the air fed into the dryer. No special feed ducts to the supply fans are required, as the temperature of the air entering the dryer enclosure is low enough (600° F. to 1000° F.) to prevent damage to any components. Also, special baffling inside the dryer insures proper mixing of the air inside the dryer. Such baffling is described in U.S. Pat. No. 5,857,270, the disclosure of which is hereby incorporated by reference. Only one high temperature damper is required to supply air to two neighboring zones. If desired, a regulating damper can be installed on the second zone outlet, but it need not be of superalloy material; standard 300 series stainless steel is adequate. No direct connections to the supply fan inlets are required.

Slight disturbances of the dryer enclosure pressure can occur at high exhaust rates after a valve switch at the oxidizer. Specifically, when a valve closes, the previously flowing fluid is reflected back to its source. In order to ameliorate this pressure disturbance, a snubbing device such as a check valve in the exhaust line from the dryer to the oxidizer can be used. The snubbing device reduces the reflected pulse by dissipating the energy through friction or momentum changes such as expansions and contractions. A barometric damper is an example of a check valve, which prevents back flow, and prevents the brief pulse of air from entering the dryer enclosure and pressurizing it above atmospheric pressure or above a desired pressure.

For some operating conditions, the amount of volatile solvents in the dryer exhaust stream will be less than that required for autothermal operation. To avoid the use of a combustion burner to provide supplemental energy, supplemental fuel may be introduced into the system, such as in the exhaust stream, to provide the needed energy. A preferred fuel is natural gas or other conventional fuel gases or liquids. The elimination of the burner operation is advantageous because the combustion air required for burner operation reduces the oxidizer efficiency and can cause the formation of $NO_x$. Introduction of fuel gas can be accomplished by sensing temperature in some location, such as in the heat exchange columns. For example, temperature sensors can be located in each of the heat exchange beds, about 18 inches below the top of the heat exchange media in each bed. Once normal operation of the apparatus begins, combustible fuel gas is applied to the process gas, by means of a T-connection prior to the process gas entering the heat exchange column, based upon the average of the temperatures detected by the sensors in each heat exchange bed. If the average of the sensed temperatures falls below a predetermined setpoint, additional fuel gas is added to the contaminated effluent entering the oxidizer. Similarly, if the average of the sensed temperatures rises above a predetermined setpoint, the addition of fuel gas is stopped.

Alternatively, combustion zone temperature may be indirectly controlled by means of measuring and controlling the energy content of the exhaust air entering the oxidizer. A suitable Lower Explosive Limit (LEL) sensor such as is available from Control Instruments Corporation, can be used to measure the total solvent plus fuel content of the exhaust air at a suitable point following the pint of supplemental fuel injection. This measurement is then used to modulate by suitable control means the injection rate of fuel to maintain a constant, predetermined level of total fuel content, typically in the range of 5 to 35% of LEL, preferably in the range of 10 to 20% LEL. If the LEL measured by the sensor is below the desired setpoint, the amount of supplemental fuel injected is increased such as by opening the control valve 9. If the LEL measured is above the setpoint, the supplemental fuel injection rate is reduced such as by closing the flow valve 9. IN the case that the solvent content from the drying process is higher than the desired LEL setpoint even with no fuel injection, the exhaust rate from the drying process may be increased to reduce the LEL such as by adjusting flow through the exhaust fan 30. This adjustment of exhaust flow is well known to those skilled in the art, and is preferably accomplished with a variable speed drive on fan 30, or by a flow control damper.

If the concentration of combustible components in the gas to be treated in the oxidizer becomes too high, excessive temperatures will occur in the apparatus that may be damaging. To avoid such excessive temperatures in the high temperature incineration or combustion zone, the gases that normally would be passed through the cooling heat exchange column can be instead bypassed around that column, then combined with other gases that have already been cooled as a result of their normal passage through the cooling heat exchange column. The combined gases can be then exhausted to atmosphere. However, for the integrated dryer application, this hot-side bypass method is difficult to implement in the space available. Accordingly, it is preferred to increase the amount of air that bypasses the out-going bed and direct it into the dryer enclosure. This extra energy is then absorbed by a water evaporating coil mounted in the supply or exhaust air stream of the dryer as shown in FIG. 13.

Figure 16A:
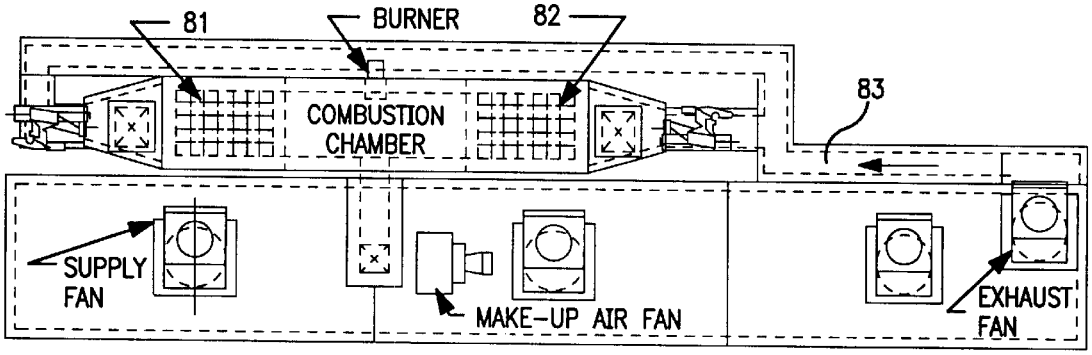
FIGS. 16A, 16B and 16C are views of apparatus having a vertically oriented oxidizer in accordance with the present invention.
Figure 16B:
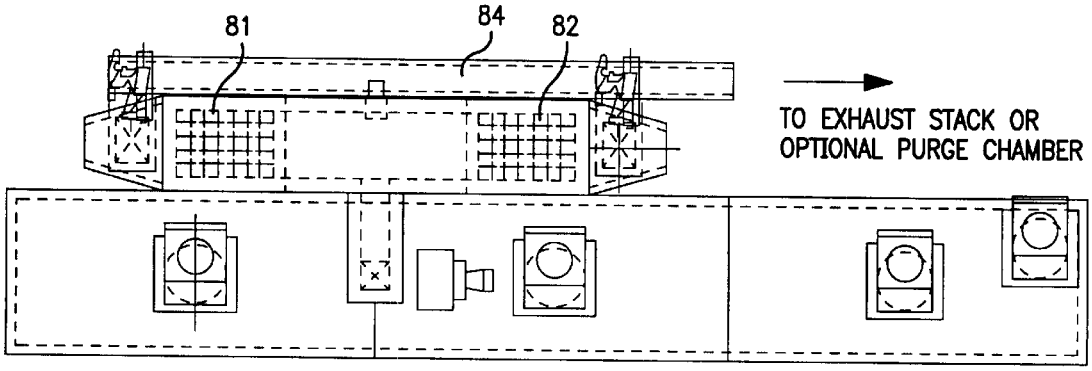
Figure 16C:
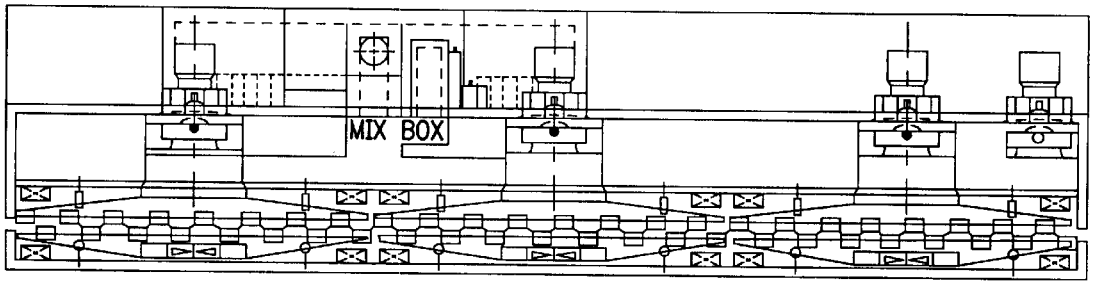

FIGS. 16A, B and C show various alternative embodiments of the present invention, where the regenerative oxidizer is configured with vertical beds 81, 82 as shown. In FIG. 16A, the supply ducting 83 leading to the vertical beds 81, 82 is shown, and in FIG. 16B, the return ducting 84 from the beds is shown. FIG. 16C shows a front view with the front cover removed to reveal dryer internals. Those skilled in the art will appreciate that the above design is not limited to two vertical beds; three or more could be used.

What is claimed is:

1. A method of drying a running web of material, comprising:

transporting said web into a dryer enclosure having a dryer atmosphere;

impinging heated air onto said web with a plurality of nozzles;

drawing a portion of said dryer atmosphere into an integrated regenerative heat exchanger comprising at least first and second heat exchange columns containing heat exchange material and in communication with a combustion zone in order to heat said portion of said dryer atmosphere;

combusting in said integrated regenerative heat exchanger volatile contaminants present in said dryer atmosphere; and bypassing one of said first and second heat exchange columns by directing a portion of the gas from said combustion zone to a water evaporating coil in communication with said combustion zone.

2. A method of drying a running web of material, comprising:

transporting said web into a dryer enclosure having a dryer atmosphere and a plurality of supply zones;

impinging heated air onto said web with a plurality of nozzles;

drawing a portion of said dryer atmosphere into an integrated regenerative heat exchanger comprising at least one heat exchange column containing heat exchange material and in communication with a combustion zone in order to heat said portion of said dryer atmosphere;

combusting in said integrated regenerative heat exchanger volatile contaminants present in said dryer atmosphere;

sensing temperature in a said supply zone;

directing a portion of the combusted gas from said combustion zone to a mixing chamber in communication with said plurality of supply zones with a cast superalloy damper by modulating said damper in response to said sensed temperature;

introducing make-up air from outside said dryer enclosure into said mixing chamber with a variable speed fan;

mixing said make-up air with said portion of the combusted gas in said mixing chamber; and directing said mixture to one or more of said plurality of nozzles in said plurality of supply zones.

3. A dryer for a web of material and having an integrated regenerative heat source, comprising:

a housing enclosure comprising:

a web inlet and a web outlet spaced from said web inlet;

a plurality of nozzles for drying said web;

a regenerative heat source comprising at least first and second heat exchange columns, each said column having a gas inlet and a gas outlet, each said column being in communication with a combustion zone, and containing heat exchange material;

valve means for alternatingly directing gas from said dryer into said gas inlet of one of said at least first and second heat exchange columns; and a water evaporating coil in said housing enclosure and in communication with said combustion zone, whereby a portion of gas in said combustion zone bypasses one of said first and second heat exchange columns and is directed to said water evaporating coil.

4. A dryer for a web of material and having an integrated regenerative heat source, comprising:

a housing enclosure comprising:

a web inlet and a web outlet spaced from said web inlet;

a plurality of supply zones;

a plurality of nozzles for drying said web;

a regenerative heat source comprising at least one heat exchange column, said at least one column having a gas inlet and a gas outlet, said at least one column being in communication with a combustion zone, and containing heat exchange material;

valve means for alternatingly directing gas from said dryer into said gas inlet of said at least one heat exchange column;

a mixing chamber in communication with said combustion zone and said plurality of supply zones, said mixing chamber receiving make-up air from outside said dryer enclosure via a variable speed fan and mixing said make-up air with air from said combustion zone and supplying said mixed air to said plurality of supply zones;

a cast superalloy damper in communication with said combustion zone and said mixing chamber;

a sensor for sensing temperature in a said supply zone; and a controller for modulating said damper in response to said sensed temperature to control the amount of air from said combustion zone allowed to enter said mixing chamber.

5. The dryer of claim 4, wherein there are at least two heat exchange columns.

6. The dryer of claim 4 or 5, wherein at least some of said plurality of nozzles are flotation nozzles for floatingly supporting said web in said housing enclosure.

7. The dryer of claim 4 or 5, wherein said heat exchange material is a combination of randomly packed media and structured media.

8. The dryer of claim 4 or 5, wherein said heat exchange material is a monolith.

9. The dryer of claim 4 or 5, further comprising an entrapment chamber having an inlet in communication with said valve means.

10. The dryer of claim 4 or 5, further comprising means for introducing a combustible fuel into said at least one heat exchange column.

11. The dryer of claim 4 or 5, wherein said heat exchange material comprises a catalyst.

12. The dryer of claim 4 or 5, wherein said heat exchange column has a first end and a second end spaced from said first end, said second end being nearer to said combustion zone than said first end; and said heat exchange material in said heat exchange column is arranged in said heat exchange column such that at least a portion of said material nearer said second end is inclined with respect to horizontal.

13. The dryer of claim 12, wherein said portion of said heat exchange material nearer said second end is inclined at an angle greater than the angle at which said heat exchange material nearer said first end is inclined.

14. The dryer of claim 12, wherein said angle at which said heat exchange material nearer said first end is inclined is 0°, and said angle at which said heat exchange material nearer said second end is inclined is 1 to 10°.

15. The dryer of claim 12, wherein said angle at which said heat exchange material nearer said second end is inclined is 1.6°.

16. The dryer of claim 4, further comprising temperature sensing means in said regenerative heat source, and bypass means responsive thereto for extracting a portion of gases from said regenerative heat source when said temperature sensing means senses a predetermined temperature.

17. The dryer of claim 4, further comprising a sensor for sensing the concentration of volatile organic solvent of said gas directed into said gas inlet.

18. The dryer of claim 10, further comprising a sensor for sensing the concentration of volatile organic solvent of said gas directed into said inlet, and wherein the amount of said combustible fuel introduced is responsive to the sensed concentration.

19. The dryer of claim 4, wherein said heat exchange material comprises plurality of plates positioned between a first stack of monolithic blocks at a first end of said heat exchange column and a second stack of monolithic blocks at a second end of said heat exchange column.

20. The dryer of claim 4, wherein said damper comprises a cast cylindrical housing, a blade having an annular sealing ring, and a shaft for actuating said blade in said housing.

21. The dryer of claim 4, wherein said mixing chamber comprises an inlet for said make-up air, an inlet for said air from said combustion zone, and an outlet for the mixture of said make-up air and said combustion zone air.

22. The dryer of claim 21, wherein said mixing chamber further comprises an inlet for recirculation air from said dryer enclosure.

* * * * *